US005997281A

United States Patent [19]

Lei

[11] Patent Number: 5,997,281

[45] Date of Patent: Dec. 7, 1999

[54] SAFETY LIGHTER

[76] Inventor: Hou Chong Lei, 2686 Palomino Dr., Covina, Calif. 91724-3806

[21] Appl. No.: 09/027,284

[22] Filed: Feb. 20, 1998

[51] Int. Cl.[6] ..... F23D 11/36; F23Q 1/02

[52] U.S. Cl. ..... 431/153; 431/274; 431/277

[58] Field of Search ..... 431/153, 277, 431/276, 274

[56] References Cited

U.S. PATENT DOCUMENTS

| | | | |
|---|---|---|---|
| 2,477,385 | 7/1949 | Mayfield | 431/277 |
| 2,770,960 | 11/1956 | Renwick, Sr. | 431/277 |
| 3,010,856 | 11/1961 | Seelig et al. | 431/277 |
| 3,063,276 | 11/1962 | Cassan | 431/277 |
| 3,262,289 | 7/1966 | Biesenbach | 431/277 |
| 3,533,718 | 10/1970 | Shuto | 431/277 |
| 3,594,108 | 7/1971 | Villarreal-Cueva | 431/277 |
| 3,814,572 | 6/1974 | Nitta | 431/276 |
| 4,717,335 | 1/1988 | Loveless | 431/277 |
| 4,822,276 | 4/1989 | Bisbee | 431/277 |
| 5,002,482 | 3/1991 | Fairbanks et al. | 431/277 |
| 5,096,414 | 3/1992 | Zellweger | 431/277 |
| 5,217,365 | 6/1993 | Frigiere | 431/277 |
| 5,490,773 | 2/1996 | Capilla | 431/153 |
| 5,547,370 | 8/1996 | Hwang | 431/276 |

*Primary Examiner*—Ira S. Lazarus
*Assistant Examiner*—David Lee

[57] ABSTRACT

A safety lighter having a safety thumb-wheel design that will prevent accidental ignition and unauthorized use by children. The safety lighter can be ignited with one easy press of the thumb-wheel without any additional manipulation of slides or switches. The safety thumb-wheel design consists of a friction thumb-wheel assembled between two side thumb-wheels on an axle. The two side thumb-wheels has a circular shallow indentation on the face that contacts the friction thumb-wheel. The inside diameter of the circular shallow indentation is slightly larger than the outside diameter of the friction thumb-wheel such that the friction thumb-wheel can be inserted in the circular shallow indentation. When pressing down with moderate force on the two side thumb-wheels, they will engage the friction thumb-wheel, which in turn bears against a flint to create a spark.

1 Claim, 2 Drawing Sheets

View I-I

SAFETY LIGHTER

BACKGROUND—FIELD OF INVENTION

This invention relates to a lighter consisting of a safety device for the thumb-wheel of a cigarette lighter, the ignition of which either accidentally or by children is rendered virtually impossible.

BACKGROUND—DESCRIPTION OF PRIOR ART

Cigarette lighters, particularly of the disposable type, are known to comprise, within a hollow body, a reservoir of combustible liquefied gas, a pressure reducer mounted on an outlet of the reservoir and a burner with a valve on top of the pressure reducer, and means for igniting the gas escaping from the burner after the valve is opened. This igniting means most often consists of a wheel bearing against a flint, rotation of the wheel producing sparks which are projected over the burner.

The gas of the cigarette lighter is ignited by pressing on a thumb-piece which is usually pivoted on the body of the cigarette lighter. In addition to creating one or more sparks, the thumb-piece lifts the burner as it moves, which releases the gas which is to be ignited.

The thumb-wheel is rotated by the user of the cigarette lighter. However, such rotation may occur accidentally, for example, in a pocket, or by an unauthorized "user", such as a child, who might misuse the cigarette lighter.

In order to overcome this drawback, the provision of the safety device for the thumb-wheel has been proposed. When the thumb-wheel is not operated in a specific manner, no spark can be generated. In order to use the cigarette lighter, the thumb-wheel must be operated in a specific intentional manner without the requirement of any special skill.

BRIEF SUMMARY OF THE INVENTION

My safety lighter is designed to be easily operable with the conventional method of using the lighter. However, the safety design of the thumb-wheel will prevent accidental ignition and will also prevent ignition by children. The safety design of the thumb-wheel does not interfere with the conventional operation of the lighter and does not require the user to operate any special slides or switches.

DETAILED DESCRIPTION OF THE INVENTION

Figure 1:
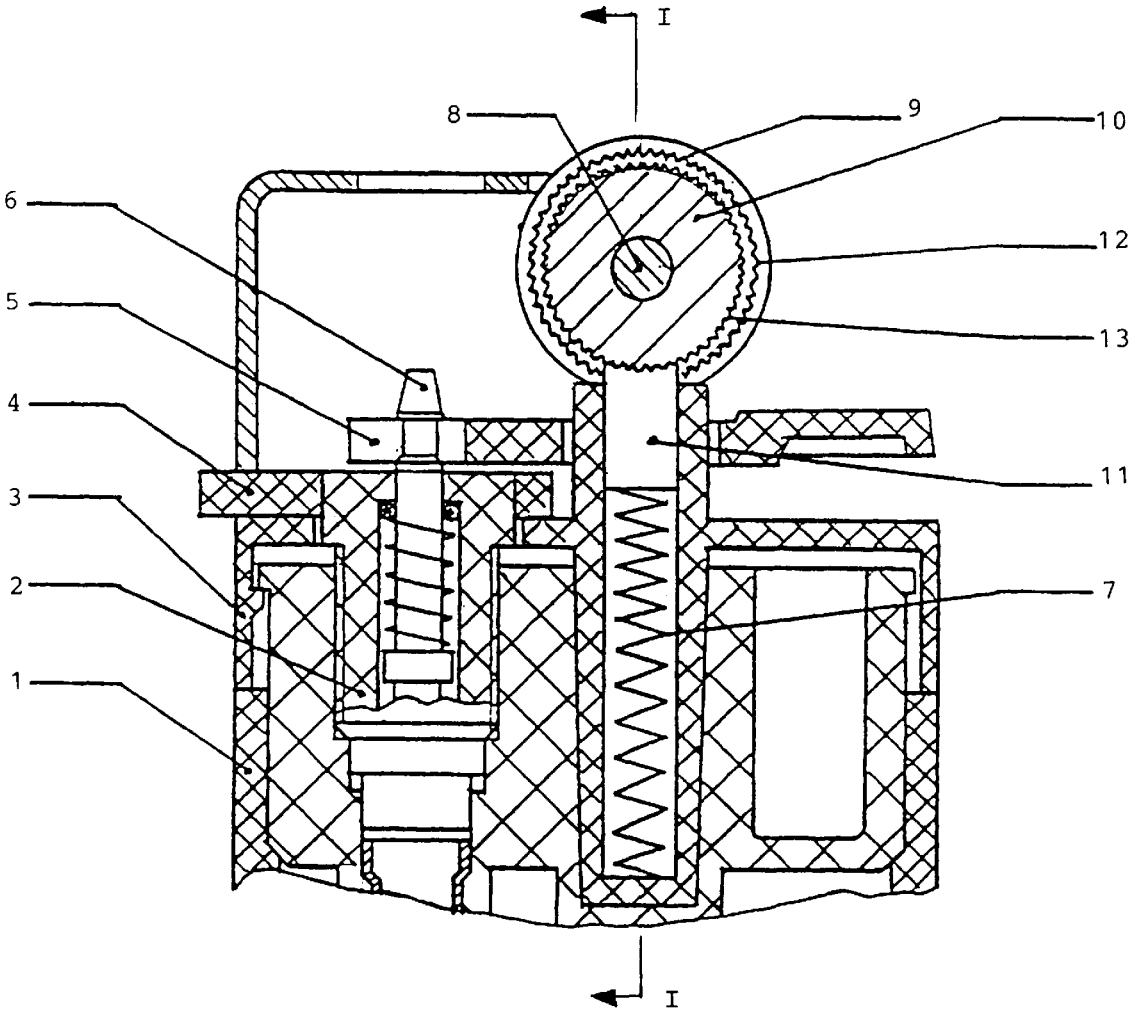
FIG. 1 shows the safety design of the thumb-wheel.

A typical embodiment of the safety lighter of the present invention is illustrated in FIG. 1. The safety lighter has a hollow body 1, a valve assembly 2, a support 3, and an ignition mean. The valve assembly 2 consists of a pressure reducer 4, a thumb-piece 5, and a burner 6. The ignition mean consists of a friction thumb-wheel 10, an axle 8, two side thumb-wheels 9, a flint 11, and a spring 7.

The friction thumb-wheel 10 is rotably assembled between the two side thumb-wheels 9 on the axle 8. The axle 8 is rotably inserted into cavities in the support 3. The two side thumb-wheels 9 has a shallow indentation on the face that contacts the friction thumb-wheel 10. The inside diameter of the shallow indentations is slightly larger than the outside diameter of the friction thumb-wheel 10 such that the friction thumb-wheel 10 can be inserted in the shallow indentation. The axle holes on the two side thumb-wheels 9 are slightly larger than the axle hole on the friction thumb-wheel 10. The two side thumb-wheels 9 and the friction thumb-wheel 10 can freely rotate independent of each other on the axle 8.

The side thumb-wheel internal friction surface 12 has small ridges on the inside of the circumference of the indentation on the side thumb-wheel 9 to increase the friction between the two side thumb-wheels 9 and the friction thumb-wheel 10.

DESCRIPTION—FIG. 2

Figure 2:
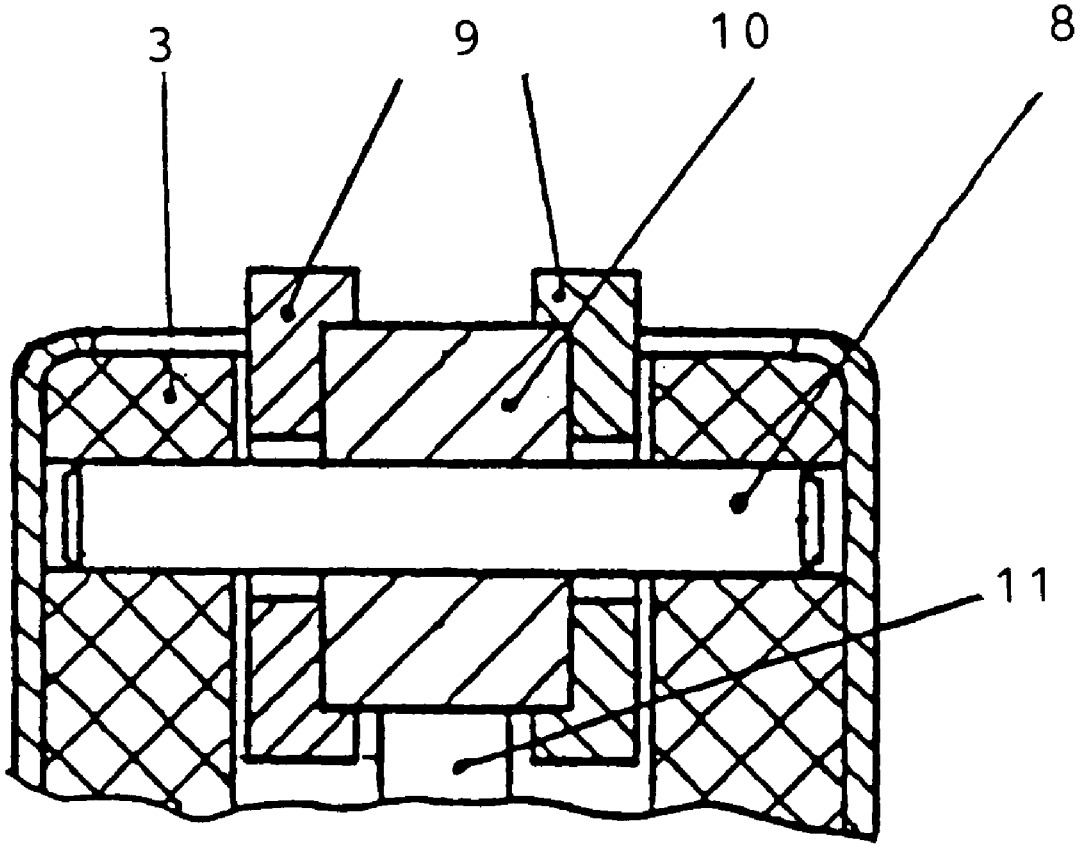
FIG. 2 shows a cross-sectional side view of the safe design thumb-wheel.

FIG. 2 shows a cross sectional view of the thumb-wheel assembly. The two side thumb-wheels 9 are assembled on the two sides of the friction thumb-wheel 10. All three thumb-wheels are rotably assembled on the axle 8, which is rotably inserted into cavities in the support 3. The friction thumb-wheel 10 engages one end of a flint 11, which is forced into the friction thumb-wheel 10 by a spring 7 on the other end of the flint 11.

The manner of using the safety lighter is by pressing down with moderate force on the two side thumb-wheels 9 which will engage the friction thumb-wheel 10 in the middle thereby causing the side thumb-wheel internal friction surface 12 to engage the friction thumb-wheel external friction surface 13 so that all three thumb-wheels rotate together. The rotating friction thumb-wheel 10 will bear against the flint 11 which is forced into the friction thumb-wheel 10 by the spring 7. The rotation of the friction thumb-wheel 10 against the flint 11 will create sparks which are projected over the burner 6. The combustible gas is release by pressure on the thumb-piece 5 through the pressure reducer 4 out through the burner 6. The combustible gas will be ignited by the sparks.

I claim:

1. A safety lighter of the type comprising a hollow body including a reservoir for gas fuel, ignition means supported at one end of the hollow body, the ignition means including a valve mechanism in fluid connection with the reservoir and operable for selectively discharging gas fuel stored in the reservoir through the valve mechanism, gas-release means connected to the valve mechanism and supported by means on the hollow body to be movable relative to the housing between a first position where gas is not discharged through the valve mechanism and a second position where gas is discharged through the valve mechanism, and a safety ignition mechanism for igniting the gas fuel discharged through the valve mechanism, wherein the safety ignition mechanism comprises a first side thumb-wheel with an axle hole in the center of its diameter, a friction thumb-wheel with an axle hole in the center of its diameter, and a second side thumb-wheel with an axle hole in the center of its diameter, wherein the first and second side thumb-wheels have a circular shallow indentation on the face that contacts the friction thumb-wheel and the inside diameter of the circular shallow indentations is slightly larger than the outside diameter of the friction thumb-wheel such that the friction thumb-wheel can be inserted in the circular shallow indentations and freely rotate independent of the first side thumb-wheel and the second side thumb-wheel, and the first side thumb-wheel and the second side thumb-wheel's circular shallow indentations' circumference has a friction surface with small ridges on the inside of the circumference of the circular shallow indentation on the first side thumb-wheel and the second side thumb-wheel, and the axle holes in the first side thumb-wheel and the second side thumb-wheel are slightly larger in diameter than the axle hole in the friction thumb-wheel, with the first side thumb-wheel, the friction thumb-wheel, and the second thumb-wheel axially assembled on a axle through their respective axle holes such that the first side thumb-wheel, the friction thumb-wheel, and the second side thumb-wheel rotate on a common axis and can rotate as one assembly, and a flint forcibly retained by a spring against the friction thumb-wheel.

* * * * *